United States Patent [19]

Yen

[11] Patent Number: 4,599,162

[45] Date of Patent: Jul. 8, 1986

[54] CASCADE HYDRODEWAXING PROCESS

[75] Inventor: Jeffrey H. Yen, Swedesboro, N.J.

[73] Assignee: Mobil Oil Corporation, New York, N.Y.

[21] Appl. No.: 684,992

[22] Filed: Dec. 21, 1984

[51] Int. Cl.[4] ..... C10G 65/10

[52] U.S. Cl. ..... 208/59; 208/111; 208/97

[58] Field of Search ..... 208/59, 111, 97

[56] References Cited

U.S. PATENT DOCUMENTS

| | | | |
|---|---|---|---|
| Re. 28,398 | 4/1975 | Chen et al. | 208/111 |
| 3,668,113 | 6/1972 | Burbidge et al. | 208/97 |
| 3,755,138 | 8/1973 | Chen et al. | 208/33 |
| 3,764,520 | 10/1973 | Kimberlin, Jr. et al. | 208/111 |
| 3,769,202 | 10/1973 | Plank et al. | 208/111 |
| 3,894,937 | 7/1975 | Bonacci et al. | 208/89 |
| 3,894,938 | 7/1975 | Gorring et al. | 208/97 |
| 3,956,102 | 5/1976 | Chen et al. | 208/93 |
| 4,053,532 | 10/1977 | Ireland et al. | 260/676 |
| 4,222,855 | 9/1980 | Pelrine et al. | 208/111 |
| 4,247,388 | 1/1981 | Banta et al. | 208/111 |
| 4,292,166 | 9/1981 | Gorring et al. | 208/59 |
| 4,370,219 | 1/1983 | Miller | 208/59 |
| 4,372,839 | 2/1983 | Oleck et al. | 208/59 |
| 4,383,913 | 5/1983 | Powell et al. | 208/59 |
| 4,419,220 | 12/1983 | LaPierre et al. | 208/111 |

*Primary Examiner*—Andrew H. Metz
*Assistant Examiner*—O. Chaudhuri
*Attorney, Agent, or Firm*—Alexander J. McKillop; Michael G. Gilman; Malcolm D. Keen

[57] ABSTRACT

Hydrocarbon feedstocks are dewaxed in a dual catalyst cascade process by passing the waxy feedstock over a crystalline silicate zeolite catalyst having a Constraint Index between 2 and 12, and then over a different crystalline silicate zeolite catalyst having a Constraint Index no less than 2.

7 Claims, 2 Drawing Figures

* 1st STAGE: Pt/ZSM-12/ZSM-23
2nd STAGE: Ni/ZSM-5

** Ni/ZSM-5

* 1st STAGE: Pt/ZSM-12/ZSM-23
2nd STAGE: Ni/ZSM-5

** Ni/ZSM-5

CASCADE HYDRODEWAXING PROCESS

CROSS-REFERENCE TO RELATED APPLICATIONS

U.S. patent application Ser. No. 685,089 filed 12/21/84 to Chen et al relates to a cascade catalytic lube process utilizing a large pore and a medium pore zeolite catalyst.

U.S. patent application Ser. No. 685,000 filed 12/21/84 to Yen relates to a dual catalyst cascade process utilizing a large pore zeolite catalyst and a zeolite having the structure of ZSM-11.

BACKGROUND OF THE INVENTION

1. Field of the Invention

This invention relates to a cascade hydroisomerization-hydrodewaxing process, and particularly to a dual catalyst cascade hydroisomerization-hydrodewaxing process utilizing a medium pore crystalline zeolite catalyst in one reaction zone and a different medium pore crystalline zeolite catalyst in another reaction zone.

2. Discussion of Prior Art

Refining suitable petroleum crude oils to obtain a variety of lubricating oils which may function effectively in diverse environments has become a highly developed and complex art. Although the broad principles involved in refining are qualitatively understood, the art is encumbered by quantitative uncertainties which require a considerable resort to empiricism in practical refining. Underlying these quantitative uncertanties is the complexity of the molecular constitution of lubricating oils. Because lubricating oils for the most part are based on petroleum fractions boiling above about 450° F. (232° C.), the molecular weights of the hydrocarbon constituents are high and these constituents display almost all conceivable structure types. This complexity and its consequences are referred to in well-known treatises, such as, for example, "Petroleum Refinery Engineering", by W. L. Nelson, McGraw-Hill Book Company, Inc., New York, NY, 1958 (Fourth Edition). For purposes of this invention, lubricating oil or lube oil is that part of a hydrocarbon feedstock having a boiling point of 650° F. (343° C.) or higher as determined by ASTM D-97 test method.

In general, the basic premise in lubricant refining is that a suitable crude oil, as shown by experience or by assay, contains a quantity of lubricant stock having a predetermined set or properties, such as, for example, appropriate viscosity, oxidation stability, and maintenance of fluidity at low temperatures. The process of refining to isolate that lubricant stock consists of a set of subtractive unit operations which removes the unwanted components. The most important of these unit operations include distillation, solvent refining and dewaxing, which basically are physical separation processes in the sense that if all the separated fractions were recombined, one would reconstitute the crude oil.

A refined lubricant stock may be used by itself, or it may be blended with another refined lubricant stock having different properties. Or, the refined lubricant stock, prior to use as a lubricant, may be compounded with one or more additives which function, for example, as antioxidants, extreme pressure additives, V.I. improvers.

For the preparation of a high grade distillate lubricating oil stock, it is known to vacuum distill an atmospheric tower residuum from an appropriate crude oil as the first step. This step provides one or more raw stocks within the boiling range of about 450° F. to 1050° F. (232°-566° C.). After preparation of a raw stock of suitable boiling range, it is extracted with a solvent, e.g., furfural, phenol, sulfolane, or chlorex, which is selective for aromatic hydrocarbons, and which removes undesirable components. The raffinate from solvent refining is then dewaxed, for example, by admixing with a solvent, such as a blend of methylethyl ketone and toluene. The mixture is chilled to induce crystallization of the paraffin waxes, which are then separated from the raffinate. Sufficient quantities of wax are removed to provide the desired pour point for the raffinate.

Other processes, such as hydrofinishing or clay percolation, may be used if needed to reduce the nitrogen and sulfur content or improve the color of the lubricating oil stock.

Viscosity index (V.I.) is a quality parameter of considerable importance for distillate lubricating oils to be used in automotive engines and aircraft engines subject to wide variations in temperature. This index indicates the degree of change of viscosity with temperature. A high V.I. of 100 indicates an oil that does not tend to become viscous at low temperature or become thin at high temperatures. Measurement of the Saybolt Universal Viscosity of an oil at 100° F. (38° C.) and 210° F. (99°), and referral to correlations, provides a measure of the V.I. of the oil. For purposes of the present invention, whenever V.I. is referred to, it is meant the V.I. as noted in the Viscosity Index tabulations of the ASTM (D567), published by ASTM, 1916 Race Street, Philadelphia, PA, or equivalent.

In recent years, catalytic techniques have become available for dewaxing of petroleum stocks. A process of that nature developed by British Petroleum, in which a Mordenite type of molecular sieve catalyst is used, is described in *The Oil and Gas Journal,* dated Jan. 6, 1975, at pages 69-73. See also U.S. Pat. No. 3,668,113.

U.S. Pat. No. Re. 28,398 describes a process for catalytic dewaxing with a catalyst comprising zeolite ZSM-5. Such a process combined with catalytic hydrofinishing is described in U.S. Pat. No. 3,894,938.

U.S. Pat. No. 3,956,102 discloses a particular method for dewaxing a petroleum distillate with a ZSM-5 catalyst. Typical aging curves are shown in Sheet 2 of the drawing of the U.S. Pat. No. 3,956,102.

U.S. Pat. No. 3,769,202 teaches catalytic conversion of hydrocarbons using as a catalyst two different crystalline silicate zeolites, one having a pore size greater than 8 Angstroms and the other having a pore size less than 7 Angstroms. This reference teaches that a conventional hydrogenation/dehydrogenation component may be added, in an amount from about 0.01 to about 30 wt %.

U.S. Pat. No. 3,764,520 teaches hydrocracking with a catalyst mixture of large and small pore crystalline zeolites.

U.S. Pat. No. 3,755,138 describes a process for mild solvent dewaxing to remove high quality wax from a lube stock, which is then catalytically dewaxed to specification pour point.

U.S. Pat. No. 4,053,532 is directed towards a hydrodewaxing operation involving a Fischer-Tropsch synthesis product utilizing ZSM-5 type zeolites.

U.S. Pat. No. 3,956,102 is connected with a process involving the hydrodewaxing of petroleum distillates utilizing a ZSM-5 type zeolite catalyst.

U.S. Pat. No. 4,247,388 describes dewaxing operations utilizing ZSM-5 type zeolites of specific activity.

U.S. Pat. No. 4,222,855 describes dewaxing operations to produce lubricating oils of low pour point and of high V.I. utilizing zeolites including ZSM-23 and ZSM-35.

U.S. Pat. No. 4,372,839 describes a method for dewaxing crude oils of high wax content by contacting the oils with two different zeolites, e.g., ZSM-5 and ZSM-35.

U.S. Pat. No. 4,419,220 describes a dewaxing process utilizing a Zeolite Beta catalyst.

U.S. Pat. No. 4,383,913 discloses a cascade process wherein the hydrocarbon feed first passes over a bed of zeolite containing catalyst, and then over a bed of amorphous catalyst.

U.S. Pat. No. 3,894,937 discloses a dual catalyst converter and process, suitable for cascade processing.

Copending U.S. patent application Ser. No. 661,632, filed 10/17/84 which is incorporated herein by reference, describes a lubricating oil dewaxing process utilizing a zeolite catalyst having a Constraint Index not less than 2; an acidic catalytic material selected from the group consisting of Mordenite, TEA Modenite, Dealuminized Y, Rare Earth Y, amorphous silica alumina, chlorinated alumina, ZSM-4 and ZSM-20; and a hydrogenation component.

Copending U.S. patent application Ser. No. 631,681, filed 7/16/84 which is incorporated herein by reference, describes a process for dewaxing a hydrocarbon feedstock using a catalyst containing, in combination, a zeolite with a Constraint Index greater than 1, a second, different catalyst component and a hydrogenation component.

Despite all the advances that have been made in catalytic hydrodewaxing, it would still be beneficial if processes could be devised which would provide increased lube yield, higher viscosity index (V.I.), improved catalyst stability and flexibility in catalyst regeneration.

It is an object of the present invention to overcome the deficiencies of the prior art.

It is additionally an object of the present invention to provide an improved process for producing a dewaxed lubricating oil having higher V.I., increased lubricating oil yield, improved catalyst stability and increased flexibility in catalyst regeneration.

These and other objects are fulfilled by the present invention, which is disclosed below.

SUMMARY OF THE INVENTION

The present invention is directed to a dual catalyst cascade hydrodewaxing process comprising:

(a) passing a hydrocarbon feedstock containing waxy components selected from a group of normal paraffins and slightly branched chain paraffins over a catalyst comprising a crystalline silicate zeolite having a Constraint Index between 2 and 12, having acidic sites, and having associated therewith a catalytically effective amount of a hydrogenation/dehydrogenation component;

(b) passing at least a majority of the normally liquid hydrocarbon recovered from step (a) over a crystalline silicate zeolite having a Constraint Index greater than 2, said zeolite of step (b) being different from said zeolite of step (a), said zeolite of step (b) having acidic sites and a catalytically effective amount of a hydrogenation/-dehydrogenation component; and (c) recovering a normally liquid hydrocarbon product having a reduced wax content relative to the feedstock, from the product of step (b).

The invention is further directed to a cascade catalytic dewaxing process comprising:

(a) passing a hydrocarbon feedstock containing long chain normal paraffins and long chain slightly branched paraffins, wherein at least a majority of the feedstock has a boiling point in excess of 482° F. (250° C.), over a crystalline silicate zeolite, said zeolite being selected from the group having the structure of ZSM-5, ZSM-11, ZSM-12, ZSM-22, ZSM-23, ZSM-35, ZSM-38, ZSM-48, TMA Offretite and mixtures thereof, said zeolite having catalytically effective amounts of a hydrogenation/dehydrogenation component in the presence of hydrogen at a temperature between 450° F. (232° C.) and 700° F. (371° C.), a pressure of about 400 psig, a hydrogen feed rate of about 2500 SCF $H_2$/bbl, and a LHSV between 0.2 and 6.0;

(b) passing the entire effluent from step (a) over a crystalline silicate zeolite, said zeolite of step (b) being different from said zeolite of step (a), said zeolite of step (b) being selected from the group consisting of ZSM-5, ZSM-11, ZSM-12, ZSM-23, ZSM-35, ZSM-38, ZSM-48, TMA Offretite, Clinoptilolite, Erionite and mixtures thereof, said zeolite of step (b) having catalytically effective amounts of a hydrogenation/dehydrogenation component in the presence of hydrogen at a temperature between 500° F. (260° C.) and 700° F. (371° C.), the temperature of step (b) being the same or different than the temperature of step (a), a pressure of about 400 psig, a hydrogen feed rate of about 2500 SFC $H_2$/bbl, and a LHSV between 0.2 and 2.0; and (c) recovering from the effluent of step (b) a hydrocarbon feed with reduced wax content.

DESCRIPTION OF PREFERRED EMBODIMENTS

Figure 1:
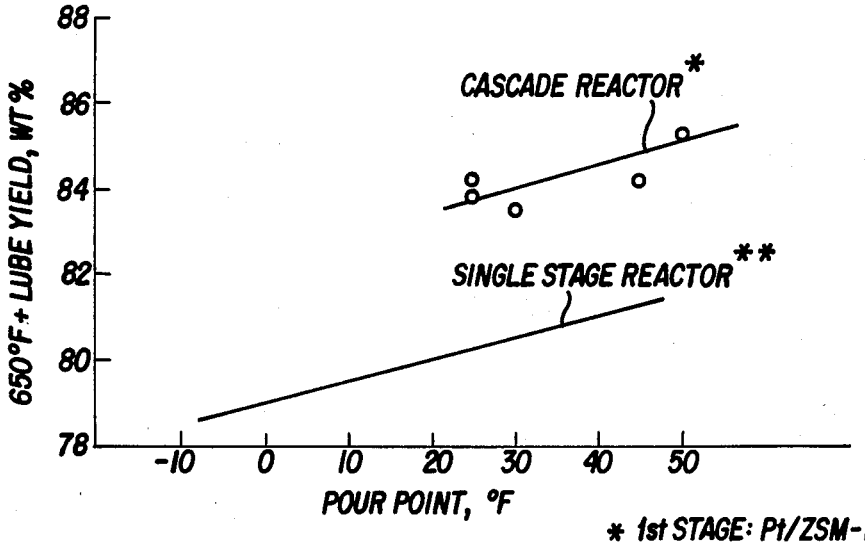
FIG. 1 illustrates the effect of a two-zone reactor and a single-zone reactor on lube yield.

The process of the present invention is preferably arranged in a two-stage cascading relationship whereby, in the first stage, the feedstock is hydroisomerized over a medium pore zeolite catalyst, followed by shape-selective dewaxing in the second stage over a different medium pore zeolite catalyst. Without wishing to be restricted to a certain theory, it is believed that a cascade relationship of these different medium pore zeolites in the right proportion will offer superior dewaxing activities and lube yield, higher V.I., improved catalyst stability in the second stage and flexibility in catalyst regeneration than the lube dewaxing catalysts of the prior art.

Feedstock

The present process may be used to dewax a variety of feedstocks ranging from relatively light distillate fractions up to high boiling stocks, such as whole crude petroleum, reduced crudes, vacuum tower residua, propane deasphalted residua, e.g., brightstock, cycle oils, FCC tower bottoms, gas oils, vacuum gas oils, deasphalted residua and other heavy oils. The feedstock will normally be a $C_{10}$+ feedstock since lighter oils will usually be free of significant quantities of waxy components. However, the process is also particularly useful with waxy distillate stocks, such as gas oils, kerosenes, jet fuels, lubricating oil stocks, heating oils, hydrotreated oil stock, furfural-extracted lubricating oil stock, and other distillate fractions whose pour point and viscosity need to be maintained within certain specification limits. Lubricating oil stocks, for example, will generally boil above 450° F. (230° C.), and more easily above 600° F. (315° C.). The process is also useful for solvent refined neutral oil and hydrocracked oil produced by the catalytic hydrocracking or hydrotreating of hydrocarbon feedstocks boiling about 650° F. (343° C.).

Catalysts

The preferred catalysts for this invention are zeolite-type catalysts. For purposes of this invention, the term "zeolite" is meant to represent the class of porotectosilicates, i.e., porous crystalline silicates, that contain silicon and oxygen atoms as the major components. Other components may be present in minor amounts, usually less than 14 mole %, and preferably less than 4 mole %. These components include aluminum, gallium, iron, boron and the like, with aluminum being preferred, and used herein for illustrating purposes. The minor components may be present separately or in mixtures.

The silica-to-alumina ($SiO_2/Al_2O_3$) mole ratio referred to may be determined by conventional analysis. This ratio is meant to represent, as closely as possible, the ratio in the rigid anionic framework of the zeolite crystal and to exclude aluminum in the binder or in cationic or other forms within the channels. Although zeolites with a silica-to-alumina mole ratio of at least 10 are useful, it is preferred to use zeolites having much higher silica-to-alumina mole ratios, i.e., ratios of at least 500:1. In addition, zeolites, as otherwise characterized herein but which are substantally free of aluminum, i.e., having silica-to-alumina mole ratios up to and including infinity, are found to be useful and even preferable in some instances. The novel class of zeolites, after activation, acquire an intracrystalline sorption affinity for normal hexane, which is greater than that for water, i.e., they exhibit "hydrophobic" properties.

A convenient measure of the extent to which a zeolite provides control to molecules of varying sizes to its internal structure is the Constraint Index of the zeolite. Zeolites which provide a highly restricted access to and egress from its internal structure have a high value for the Constraint Index, and zeolites of this kind usually have pores of small size. On the other hand, zeolites which provide relatively free access to the internal zeolite structure have a low value for the Constraint Index. The method by which Constraint Index is determined is described fully in U.S. Pat. No. 4,016,218, to which reference is made for details of the method.

Constraint Index (CI) values for some typical materials are:

| | CI |
|---|---|
| ZSM-4 | 0.5 |
| ZSM-5 | 6–8.3 |
| ZSM-11 | 6–8.7 |
| ZSM-12 | 2 |
| ZSM-20 | 0.5 |
| ZSM-23 | 9.1 |
| ZSM-34 | 30–50 |
| ZSM-35 | 4.5 |
| ZSM-38 | 2 |

-continued

| | CI |
|---|---|
| ZSM-48 | 3.5 |
| ZSM-50 | 1–3 |
| TMA Offretite | 3.7 |
| TEA Mordenite | 0.4 |
| Clinoptilolite | 3.4 |
| Modenite | 0.5 |
| REY | 0.4 |
| Amorphous Silica-Alumina | 0.6 |
| Dealuminized Y (Deal Y) | 0.5 |
| Chlorinated Alumina | *1 |
| Erionite | 38 |
| Zeolite Beta | 0.6–1+ |

*Less Than

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby exhibit different Constraint Indices. Constraint Index seems to vary somewhat with severity of operation (conversion) and the presence or absence of binders. Likewise, other variables, such as crystal size of the zeolite, the presence of occluded contaminants, etc., may affect the Constraint Index. Therefore, it will be appreciated that it may be possible to so select test conditions as to establish more than one value for the Constraint Index of a particular zeolite. This explains the range of Constraint Indices for zeolites, such as ZSM-5, ZSM-11, ZSM-34 and Zeolite Beta.

Zeolite ZSM-3 is taught by U.S. Pat. No. 3,415,736, the disclosure of which is incorporated herein by reference.

Zeolite ZSM-4 is taught by U.S. Pat. No. 3,923,639, the disclosure of which is incorporated herein by reference.

Zeolite ZSM-5 is taught by U.S. Pat. No. 3,702,886, and U.S. Pat. No. 29,949, the disclosures of which are incorporated herein by reference.

Zeolite ZSM-11 is taught by U.S. Pat. No. 3,709,979, the disclosure of which is incorporated herein by reference.

Zeolite ZSM-12 is taught by U.S. Pat. No. 3,832,449, the disclosure of which is incorporated herein by reference.

Zeolite ZSM-18 is taught by U.S. Pat. No. 3,950,496, the disclosure of which is incorporated herein by reference.

Zeolite ZSM-20 is taught by U.S. Pat. No. 3,972,983, the disclosure of which is incorporated herein by reference.

Zeolite ZSM-23 is taught by U.S. Pat. No. 4,076,342, the disclosure of which is incorporated herein by reference.

Zeolite ZSM-34 is taught by U.S. Pat. No. 4,086,186, the disclosure of which is incorporated herein by reference.

Zeolite ZSM-35 is described by U.S. Pat. No. 4,016,245, the disclosure of which is incorporated herein by reference.

Zeolite ZSM-38 is described in U.S. Pat. No. 4,046,859, the disclosure of which is incorporated herein by reference.

Zeolite ZSM-48 is described in U.S. Pat. No. 4,397,827, the disclosure of which is incorporated herein by reference.

U.S. patent application Ser. No. 386,456 to Valyocsik dated June 8, 1982, which is incorporated herein by reference, discloses a synthetic porous, crystalline material designated as ZSM-50, a method for its preparation and to its use in catalytic conversion of organic compounds.

Zeolite Beta is described in U.S. Pat. Nos. 3,308,069 and Re. 28,341, the disclosures of which are incorporated herein by reference.

Low sodium Ultrastable Y molecular sieve (USY) is described in U.S. Pat. Nos. 3,293,192 and 3,449,070, the disclosures of which are incorporated herein by reference.

It is to be realized that the above CI values typically characterize the specified zeolites, but that such are the cumulative result of several variables used in determination and calculation thereof. Thus, for a given zeolite exhibiting a CI value within the range of 1 to 12, depending on the temperature employed within the aforenoted range of 550° F. (288° C.) to 950° F. (510° C.), with accompanying conversion between 10% and 60%, the CI may vary within the indicated range of 1 to 12. Likewise, other variables such as the crystal size of the zeolite, the presence of possibly occluded contaminants and binders intimately combined with the zeolite may affect the CI. It will accordingly be understood to those skilled in the art that the CI, as utilized herein, while affording a highly useful means for characterizing the zeolites of interest is approximate, taking into consideration the manner of its determination, with the probability, in some instances, of compounding variable extremes. However, in all instances, at a temperature within the above-specified range of 550° F. (288° C.) to 950° F. (510° C.), the CI will have a value for any given zeolite of interest herein within the approximate range of 1 to 12.

Reaction Conditions

Basically, any catalytic hydrodewaxing conditions which have been found satisfactory in the prior art may be used in the practice of the present invention. The process of the present invention makes more efficient use of the zeolite catalyst, so that a significant gain in activity is obtained, but not enough of a gain in activity to result in any radical change of operating conditions.

In general, hydrodewaxing conditions include a temperature of between about 450° F. (230° C.) and about 750° F. (400° C.), and a pressure between 0 and 1000 psig, preferably about 400 psig. The overall liquid hourly space velocity (LHSV), i.e., volume of feedstock per volume of catalyst per hour, is generally in the range of 0.1 to 5.0, and preferably in the range of 0.2 to 2.0, and the individual LHSV for each reactor zone is generally in the range of 0.1 to 10.0, and preferably in the range of 0.2 to 6.0. Both stages of the cascade process are operated in the presence of hydrogen at a hydrogen feed rate (hydrogen-to-feedstock ratio) of generally between about 400 and about 8000, preferably between about 800 and 4000, and most preferably about 2500 standard cubic feet of hydrogen per barrel of feed (SCF $H_2$/bbl).

The catalytic dewaxing process of this invention may be conducted by contacting the feed to be dewaxed with a fixed, stationary bed of the defined crystalline silicate zeolite catalyst, a slurry bed or with a transport bed, as desired. The catalysts themselves can be loaded into a two-zone reactor or two separator reactors.

Cascade Reaction System

By cascade operation, it is meant that at least about 90%, and preferably all, of the material passed over the catalyst in the first reactor is also passed over the catalyst in the second and subsequent reactors. There can optionally be an intermediate separation or cooling of fluid going from one reaction zone to the next.

In its simplest form, a cascade operation may be achieved by using a large down flow reactor, wherein the lower portion contains the catalyst comprising a zeolite having a Constraint Index greater than 2 and the upper portion contains the catalyst comprising a different zeolite having a Constraint Index between 2 and 12.

More than two reactors in series may also be used, e.g., a three-reactor system may be used. It is preferred that the catalyst in the first reactor have a larger pore size than the catalyst in the second and subsequent reactors. Both stages are operated in the presence of hydrogen and under the same pressure.

It is frequently advantageous to conduct hydrotreating either immediately before or after catalytic dewaxing. Hydrotreating will usually be practiced when necessary to remove sulfur or nitrogen or to meet some other product specification. Hydrotreating the feed before subjecting it to catalytic dewaxing advantageously converts many of the catalyst poisons in the hydrotreater or deposits them on the hydrotreating catalyst. Any conventional hydrotreating catalyst and processing conditions may be used.

Catalysts

The class of zeolites useful herein are termed medium or intermediate pore zeolites and have a Constraint Index between 2 and 12 in the first reactor and a Constraint Index greater than 2 in the second reactor. The zeolites also have an effective pore size of generally not greater than about 7 Angstroms, such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of silicon and aluminum atoms, then access by molecules of larger cross-section than normal hexane is excluded and the zeolite is not of the desired type. Windows of 10-membered rings are preferred, although, in some instances, excessive puckering of the rings or pore blockage may render these zeolites ineffective.

Although 12-membered rings in theory would not offer sufficient constraint to produce advantageous conversions, it is noted that the puckered 12-ring structure of TMA offretite does show some constrained access. Other 12-ring structures may exist which may be operative for other reasons, and therefore, it is not the present intention to entirely judge the usefulness of a particular zeolite solely from theoretical structural considerations.

The preferred zeolites in the first reactor include those having the structure of ZSM-12, ZSM-23, ZSM-35, ZSM-38, ZSM-48, ZSM-50 and mixtures thereof, with ZSM-12 being particularly preferred.

The preferred zeolites in the second reactor include those having the structure of ZSM-5, ZSM-11, ZSM-34, ZSM-38, TMA Offretite and Erionite, with ZSM-5 being particularly preferred.

The medium pore zeolite should also contain a hydrogenation/dehydrogenation component, referred to for convenience as a hydrogenation component. The hydrogenation component is generally a metal or metals of Groups IB, IIB, VA, VIA or VIIIA of the Periodic Table (IUPAC and U.S. National Bureau of Standards approved Table, as shown, for example, in the Chart of the Fisher Scientific Company, Catalog No. 5-702-10). The preferred hydrogenation components are the noble metals of Group VIIIA, especially platinum, but other noble metals, such as palladium, gold, silver, rhenium or rhodium, may also be used. Combinations of noble metals, such as platinum-rhenium, platinum-palladium, platinum-iridium or platinum-iridium-rhenium, together with combinations with non-noble metals, particularly of Groups VIA and VIIIA are of interest, particularly with metals such as cobalt, nickel, vanadium, tungsten, titanium and molybdenum, for example, platinum-tungsten, platinum-nickel or platinum-nickel-tungsten. Base metal hydrogenation components may also be used, especially nickel, cobalt, molybdenum, tungsten, copper or zinc. Combinations of base metals, such as cobalt-nickel, cobalt-molybdenum, nickel-tungsten, cobalt-nickel-tungsten or cobalt-nickel-titanium, may also be used.

The metal may be incorporated into the catalyst by any suitable method, such as impregnation or exchange, onto the zeolite. The metal may be incorporated in the form of a cationic, anionic or neutral complex, such as $Pt(NH_3)_4^{2+}$; and cationic complexes of this type will be found convenient for exchanging metals onto the zeolite. Anionic complexes are also useful for impregnating metals into the zeolites.

The acidic component of the zeolite is preferably a porous crystalline zeolite. The crystalline zeolite catalysts used in the catalyst comprise a three-dimensional lattice of $SiO_4$ tetrahedra, cross-linked by the sharing of oxygen atoms and which may optionally contain other atoms in the lattice, especially aluminum in the form of $AlO_4$ tetrahedra; the zeolite will also include a sufficient cationic complement to balance the negative charge on the lattice. Acidic functionality may, of course, be varied by artifices including base exchange, steaming or control of silica:alumina ratio.

The isomerization reaction is one which requires a relatively small degree of acidic functionality in the catalyst. Because of this, the zeolite may have a very high silica:alumina ratio, since this ratio is inversely related to the acid site density of the catalyst. Thus, as mentioned previously, structural silica:alumina ratios of 50:1 or higher are preferred and, in fact, the ratio may be much higher, e.g., 100:1, 200:1, 500:1, 1000:1, or even higher. Since zeolites are known to retain their acidic functionality even at very high silica:alumina ratios of the order of 25,000:1, ratios of this magnitude or even higher are contemplated.

The original cations associated with each of the crystalline silicate zeolites utilized herein may be replaced by a wide variety of other cations according to techniques well known in the art. Typical replacing cations include hydrogen, ammonium, alkyl ammonium and metal cations, including mixtures of the same. Of the replacing metallic cations, particular preference is given to cations of metals such as rare earth metals, manganese, as well as metals of Group II A and B of the Periodic Table, e.g., zinc, and Group VIII of the Periodic Table, e.g., nickel, platinum and palladium.

Typical ion exchange techniques are to contact the particular zeolite with a salt of the desired replacing cation. Although a wide variety of salts can be employed, particular preference is given to chlorides, nitrates and sulfates.

Representative ion exchange techniques are disclosed in a wide variety of patents, including U.S. Pat. Nos. 3,140,249; 3,140,251; and 3,140,253.

Following contact with a solution of the desired replacing cation, the zeolite is then preferably washed with water and dried at a temperature ranging from 150° F. (65° C.) to about 600° F. (315° C.) and thereafter calcined in air, or other inert gas at temperatures ranging from about 500° to 1500° F. (260°–815° C.) for periods of time ranging from 1 to 48 hours or more. It has been further found that catalysts of improved selectivity and other beneficial properties may be obtained by subjecting the zeolite to treatment with steam at elevated temperatures ranging from 500° to 1200° F. (399°–538° C.), and preferably 750° to 1000° F. (260°–649° C.). The treatment may be accomplished in an atomosphere of 100% steam or an atmosphere consisting of steam and a gas which is substantially inert to the zeolites. A similar treatment can be accomplished at lower temperature and elevated pressure, e.g., 350° to 700° F. (177°–371° C.) at 10 to about 200 atmospheres.

The crystalline silicate zeolite utilized in the process of this invention is desirably employed in intimate combination with one or more hydrogenation components, such as tungsten, vanadium, zinc, molybdenum, rhenium, nickel, cobalt, chromium, manganese, or a noble metal such as platinum or palladium, in an amount between 0.1 and about 25% by weight, normally 0.1 to 5% by weight especially for noble metals, and preferably 0.3 to 3% by weight. Such component can be exchanged into the composition, impregnated thereon or physically intimately admixed therewith. Such component can be impregnated into or onto the zeolite, such as, for example, in the case of platinum, by treating the zeolite with a platinum metal-containing ion. Thus, suitable platinum compounds include chloroplatinic acid, platinous chloride and various compounds containing the platinum amine complex.

The compounds of the useful platinum or other metals can be divided into compounds in which the metal is present in the cation of the compound and compounds in which it is present in the anion of the compound. Both types of compounds which contain the metal in the ionic state can be used. A solution in which platinum metals are in the form of a cation or cationic complex, e.g., $Pt(NH_3)Cl_2$, is particularly useful.

The present invention will now be illustrated by examples which are not intended to limit the scope of the present application.

EXAMPLES

In the Examples, the chargestock was a light neutral lubricating oil chargestock having the following properties:

| | |
|---|---|
| Specific Gravity | .8774 |
| API° | 29.8 |
| Pour Point | 85° F. |
| Viscosity KV at 100° C. | 5.341 |
| Sulfur | 0.76 wt % |

-continued

| ASTM Color | *L1.0 |
|---|---|

*L = Less Than

Example 1 is a comparative example, showing the effects of Ni-ZSM-5 on the chargestock as it was passed over the catalyst in a single reactor operation.

EXAMPLE 1

Example 1 illustrates the effect of steamed 1% Ni/ZSM-5 catalyst on the chargestock as it was passed over the catalyst in a single reactor application. The catalyst was loaded into a fixed-bed reactor. The catalyst was reduced in situ at 900° F. (482° C.) and 400 psig $H_2$ for 1 hour. Thereafter the reactor temperature was lowered to the desired setting, the chargestock was passed over the catalyst along with hydrogen under the controlled process conditions which are recited in Table 1. The product stream leaving the reactor was passed through a heated trap, a cold-water trap, and a gas-sampling bomb. The gas samples were analyzed by mass spectrometry for $C_1$–$C_6$ components. Liquid products were topped, under less than 0.1 mm Hg pressure and maximum pot temperature of 400° F. (204° C.), to isolate the 650° F.+ fraction. Some of the topped samples were processed through a simulated distillator. The light liquid products, i.e., the condensate from the cold trap and the overhead from the topped samples, were analyzed by gas chromatography. Overall material balances were made based on total liquid feed charge plus hydrogen. The results are recited in Table 1.

TABLE 1

| | |
|---|---|
| Temperature, °F. (°C.) | 580 (304) |
| Pressure, psig | 400 |
| Gas | $H_2$ |
| Circulation, SCF/bbl | 2500 |
| LHSV, v/v/hr | 1.00 |

TABLE 1-continued

| Yields, Wt % | |
|---|---|
| $C_1 + C_2$ | 0.1 |
| $C_3$ | 1.5 |
| $C_4$ | 4.0 |
| $C_5$ | 4.3 |
| $C_6$ - 650° F. | 10.8 |
| 650° F.+ Lube | 79.5 (610° F.) |
| API° Gravity | 28.6 |
| Pour Point, °F. | 15 |
| KV at 40° C. | 42.99 |
| KV at 100° C. | 6.325 |
| Viscosity Index | 92.8 |

EXAMPLES 2 TO 8

Examples 2–8 illustrate a dual catalyst cascade operation in a two-zone reactor employing 0.44% Pt/ZSM-12 and ZSM-23 in admixture in the first reactor zone, and Ni/ZSM-5 in the second reactor zone. A fixed-bed down-flow operation was employed for the cascade two-zone scheme. Both catalysts were reduced in situ under 400 psig $H_2$ and at a temperature of 900° F. (482° C.) for 1 hour. Thereafter, the reactor temperature was lowered to the desired setting and the chargestock was pumped into the reactors along with hydrogen. The results and process conditions are given in Table 2.

TABLE 2

| Example No. | 2 | 3 | 4 | 5 | 6 | 7 | 8 |
|---|---|---|---|---|---|---|---|
| Temperature, °F. (°C.) | | | | | | | |
| First Reactor | 501 | 501 | 501 | 513 | 513 | 530 | 558 |
| Second Reactor | 539 | 549 | 550 | 550 | 550 | 565 | 564 |
| Pressure, psig | 400 | 400 | 400 | 400 | 400 | 400 | 400 |
| $H_2$ Circulation (SCF/bbl) | 2500 | 2500 | 2500 | 2500 | 2500 | 2500 | 2500 |
| Time on Stream, Days | 0.5 | 1.5 | 3.4 | 5.5 | 6.8 | 7.5 | 8.4 |
| Run Time, Hrs | 21 | 21 | 21 | 66 | 20 | 21 | 19 |
| LHSV, v/v/hr | 1.01 | 0.99 | 0.98 | 1.01 | 1.02 | 1.01 | 1.00 |
| Yields, Wt % | | | | | | | |
| $C_1$–$C_5$ | — | 7.4 | 9.6 | 9.4 | 9.8 | 8.7 | 8.3 |
| $C_6$ - 650° F. | — | 8.8 | 6.3 | 5.5 | 6.7 | 7.1 | 7.4 |
| 650° F.+ Lube | — | 83.8 | 84.1 | 85.1 | 83.5 | 84.2 | 84.3 |
| Specific Gravity | 0.8804 | 0.8799 | 0.8785 | 0.8783 | 0.8805 | 0.8802 | 0.8796 |
| API° Gravity | 29.2 | 29.5 | 29.6 | 29.6 | 29.2 | 29.3 | 29.4 |
| Pour Point, °F. | 30 | 25 | 45 | 50 | 30 | 25 | 35 |
| Cloud Point, °F. | 46 | 46 | 70 | 74 | 42 | 44 | 50 |
| KV at 100° F., cs | 44.39 | 44.34 | 42.18 | 41.73 | 44.68 | 44.34 | 43.62 |
| KV at 210° F., cs | 6.326 | 6.344 | 6.210 | 6.189 | 6.366 | 6.345 | 6.299 |
| KV at 40° C. | 40.10 | 40.07 | 38.18 | 37.79 | 40.37 | 40.07 | 39.44 |
| KV at 100° C., cs | 6.176 | 6.194 | 6.065 | 6.045 | 6.215 | 6.195 | 6.150 |
| SUS at 100° F. | 207 | 207 | 196.7 | 194.6 | 208 | 207 | 203 |
| SUS at 210° F. | 46.9 | 47 | 46.6 | 46.5 | 47.1 | 47 | 46.8 |
| Viscosity Index | 99.2 | 100.1 | 103.1 | 104.1 | 99.7 | 100.2 | 101.0 |
| Sulfur, Wt % | 0.87 | 0.87 | 0.88 | 0.84 | 0.84 | 0.84 | 0.78 |
| Basic Nitrogen, ppm | 13 | 33 | 36 | 36 | 35 | 35 | 36 |
| Nitrogen, ppm | 19 | 35 | 32 | 38 | 34 | 36 | 36 |
| Hydrogen, Wt % | 13.71 | 13.60 | 13.68 | 13.74 | 13.64 | 13.65 | 13.52 |
| CCR, Wt % | L0.01 | L0.01 | L0.01 | L0.01 | L0.01 | L0.01 | L0.01 |
| Bromine Number | 1.9 | 1.7 | 1.2 | 1.5 | 1.2 | 1.1 | 1.2 |
| ASTM Color | L1.0 | L1.0 | L1.0 | L1.0 | L1.0 | L1.0 | L1.0 |

L = Less Than

Figure 2:
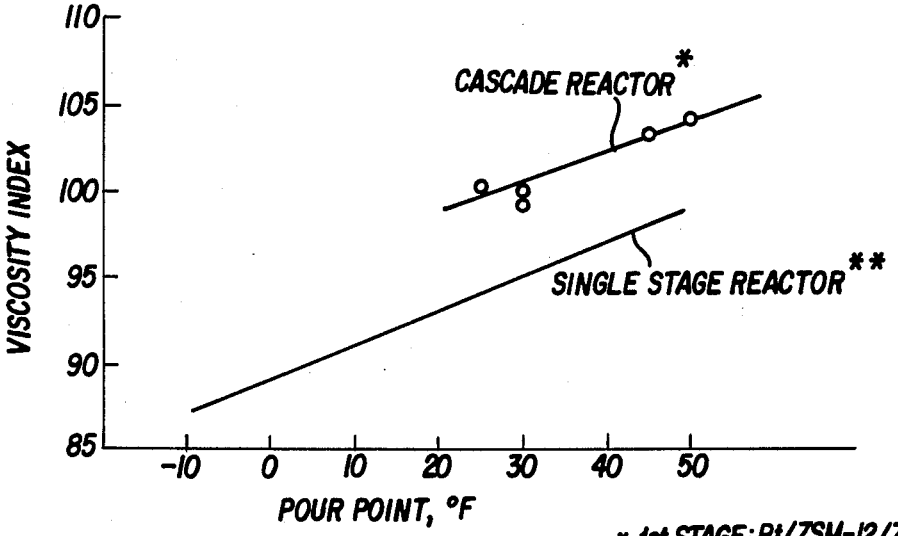
FIG. 2 illustrates the effect of a two-zone reactor and a single-zone reactor on viscosity index.

FIG. 1 illustrates the advantages of the two-zone cascade reactor over the single-zone reactor with respect to lube yield. By using the cascade-type reactor, lube yield is increased by about 3.5 wt %. Additionally, as illustrated in FIG. 2, which compares the two-stage cascade reactor with the single reactor with respect to viscosity index, an advantage in excess of four numbers can be seen.

Additionally, the Examples illustrate that the cascade reactor system enhances catalytic activity by 15° to 40° F. The present invention results in a better lube yield, a higher viscosity index, and improved catalyst stability for the second stage process than with a standard lube dewaxing process in which lube base stocks are dewaxed only over medium pore zeolite catalysts.

Although the invention has been described in conjunction with specific embodiment, it is evident that many alternatives and variations will be apparent to those skilled in the art in light of the foregoing description. Accordingly, the invention is intended to embrace all of the alternatives and variations that fall within the spirit and scope of the appended claims.

I claim:

1. A cascade catalytic hydrodewaxing process comprising:

(a) passing a hydrocarbon feedstock containing waxy components selected from a group of normal paraffins and slightly branched chain paraffins over a hydroisomerization catalyst comprising a crystalline silicate zeolite having the structure of ZSM-12 in admixture with a crystalline silicate zeolite having the structure of ZSM-23, said admixture having hydrogenation/dehydrogenation activity to hydroisomerize the feedstock; and (b) passing at least a majority of the normally liquid hydrocarbon recovered from step (a) over a dewaxing catalyst comprising a crystalline silicate zeolite having a structure of ZSM-5, said zeolite of step (b) having hydrogenation/dehydrogenation activity to dewax the recovered hydrocarbon.

2. The process of claim 1, wherein said hydrocarbon feedstock is passed over said admixture of step (a) in the presence of hydrogen at a temperature between 500°-700° F., a pressure of about 400 psig, a hydrogen feed rate of about 2500 SCF $H_2$/bbl, and a LHSV between 0.2 and 6.0; and the effluent of step (a) is passed over the zeolite of step (b) in the presence of hydrogen at a temperature between 500°-700° F., a pressure of about 400 psig, a hydrogen feed rate of about 2500 SCF $H_2$/bbl, and a LHSV between 0.2 and 3.0.

3. The process of claim 1, wherein said zeolites of steps (a) and (b) comprise hydrogenation components independently selected from the group of metals of Group VI, VII and VIII of the Periodic Table and mixtures thereof.

4. A cascade catalytic dewaxing process comprising:

(a) passing a hydrocarbon feedstock containing long chain normal paraffins and long chain slightly branched paraffins, wherein at least a majority of said feedstock has a boiling point in excess of 250° C., over a crystalline silicate zeolite having the structure of ZSM-12 in admixture with a crystalline silicate zeolite having the structure of ZSM-23, said zeolite admixture having a silica-to-alumina mole ratio of at least 10, acidic sites, and hydrogenation/dehydrogenation activity in the presence of hydrogen at a temperature between about 500° and 700° F., a pressure of about 400 psig, a hydrogen feed rate of about 2500 SCF $H_2$/bbl, and a LHSV between 0.2 and 6.0;

(b) passing the entire effluent from step (a) over a crystalline silicate zeolite having the structure of ZSM-5, said zeolite of step (b) having hydrogenation/dehydrogenation activity in the presence of hydrogen at a temperature between 500° and 700° F., said temperature of step (b) being the same or different than said temperature of step (a), a pressure about 400 psig, a hydrogen feed rate of about 2500 SCF $H_2$/bbl, and a LHSV between 0.2 and 3.0; and (c) recovering from the effluent of step (b) a hydrocarbon feed with reduced wax content.

5. The process of claim 4, wherein said zeolites of steps (a) and (b) comprise hydrogenation components independently selected from the group of metals of Group VI, VII and VIII of the Periodic Table, and mixtures thereof.

6. The process of claim 5, wherein said hydrogenation components are Group VIII noble metals present in an amount equal to 0.1 to 5 wt %, on an elemental metal basis.

7. The process of claim 5, wherein said hydrogenation components are Group VIII noble metals, present in an amount equal to 0.3 to 3 wt %, calculated on an elemental metal basis.

* * * * *